US005115548A

United States Patent [19]

Nysten

[11] Patent Number: 5,115,548

[45] Date of Patent: May 26, 1992

[54] BUTTON FOR USE ON GARMENTS AND THE LIKE

[75] Inventor: Bernhard Nysten, Aachen, Fed. Rep. of Germany

[73] Assignee: William Prym-Werke GmbH & Co. KG, Stolberg, Fed. Rep. of Germany

[21] Appl. No.: 572,896

[22] Filed: Aug. 24, 1990

[30] Foreign Application Priority Data

Aug. 29, 1989 [DE] Fed. Rep. of Germany ..... 3928529
Mar. 31, 1990 [DE] Fed. Rep. of Germany ..... 4010427

[51] Int. Cl.[5] ..... A44B 1/04

[52] U.S. Cl. ..... 24/90 R; 24/95; 24/113 MP

[58] Field of Search ..... 24/90 R, 94, 95, 90 A, 24/107, 113 R, 113 MP, 689

[56] References Cited

U.S. PATENT DOCUMENTS

| | | | |
|---|---|---|---|
| 450,069 | 4/1891 | Hall | 24/95 |
| 1,434,491 | 11/1922 | Hubbell | 24/94 |
| 2,172,594 | 9/1939 | Purinton | 24/95 |
| 4,541,558 | 9/1985 | Herten . | |
| 4,566,182 | 1/1986 | Altwicker . | |
| 4,596,349 | 6/1986 | Herten . | |
| 4,659,001 | 4/1987 | Herten . | |
| 4,694,984 | 9/1987 | Altwicker . | |
| 4,703,882 | 11/1987 | Herten . | |
| 4,941,234 | 7/1990 | Watanabe et al. | 24/90 A X |

FOREIGN PATENT DOCUMENTS

| | | | |
|---|---|---|---|
| 2734218 | 2/1979 | Fed. Rep. of Germany . | |
| 8757 | of 1904 | United Kingdom | 24/94 |

*Primary Examiner*—James R. Brittain
*Attorney, Agent, or Firm*—Peter K. Kontler

[57] ABSTRACT

A button wherein the deformable shank of a rivet (which carries the enlarged portion that is to pass through a buttonhole) must be caused to penetrate through a layer of textile or other carrier material and to thereupon enter a retaining device having a portion which deforms the free end portion of the rivet. The rivet is part of the male component of a universal joint which further comprises a socket secured to the rear surface of the enlarged portion. The retaining device has a shallow metallic cup- or pan-shaped enclosure for the rear portion of an elastically deformable insert which is deformed by the shank while the shank penetrates into and is deformed by the enclosure whereby the insert blocks extraction of the deformed shank from the enclosure and sealingly engages the adjacent rear side of the carrier material to prevent the flow of air and/or water through the hole which is formed in the carrier material as a result of penetration of the shank through the carrier material on its way into the retaining device. The insert fills the enclosure and is maintained in stressed condition when the deformation of the shank is completed.

41 Claims, 2 Drawing Sheets

BUTTON FOR USE ON GARMENTS AND THE LIKE

BACKGROUND OF THE INVENTION

The invention relates to notions in general, and more particularly to improvements in buttons. Still more particularly, the invention relates to improvements in buttons of the type wherein the head has a shank which can be caused to penetrate through a carrier (such as a layer of textile material forming part of a garment, tent or the like) and to be thereupon deformed so as to expand and hold the head against separation from the carrier.

It is known to provide the head of a button with a shank which is deformable, subsequent to penetration through a carrier, as a result of impact against a deforming device. The head of a properly attached button is located at the front side of a textile or other penetrable carrier and can be caused to pass through the buttonhole of a layer of textile or other material which is placed over the carrier of the button so that the carrier and the layer are separably connected to each other. It is also known to provide the head of such button with a universal joint which connects an enlarged portion of the head (namely the portion which is to pass through a buttonhole) with the shank so that the enlarged portion is free to turn relative to the shank about any one of a number of mutually inclined axes. If the button is used in a garment, a first layer of textile material carries the button and another layer of textile material has a buttonhole for the enlarged portion of the head.

Published German patent application No. 27 34 218 discloses a button wherein the retaining portion includes a profiled sleeve and the head of the button has a stem which extends into the sleeve. The head is located at the front side of the carrier and has an enlarged portion outside of the sleeve (such enlarged portion can be caused to pass through buttonhole) and an enlarged section which acts not unlike the ball of a ball and socket joint and is turnably received in the sleeve. The sleeve further carries a rivet which extends through the carrier of the button and into a deforming cup at the rear side of the carrier. A drawback of the button which is described in the published German patent application is that it does not properly seal the hole which is formed where the rivet passes through the carrier. This permits wind and/or rain to penetrate through the hole of the carrier. Reliable seals at locations where the rivets of such buttons extend through a piece of fabric forming part of a garment are particularly desirable in certain types of garments, such as windbreaker jackets, raincoats, slickers, jackets to be worn by skiers and many other types of outdoor garments and garments to be worn by sports persons and being likely to be exposed to elements when in actual use. Many garments of the just outlined characters embody so-called climatic membranes which overlie pieces of textile material and are impermeable to fluids.

It has been found that the ability of garments, tents and like commodities to prevent penetration of wind and/or moisture is often destroyed, even if the garments or tents are provided with climatic membranes, because the shanks of rivets must penetrate through the membranes. Attempts to seal the punctured portions of membranes include the utilization of sealing strips which are bonded (e.g., welded or adhesively secured) to the perforated portions of the membranes, normally at the inner sides of the respective carriers. The application of sealing strips is a time-consuming operation which contributes to the cost of the ultimate product, and the applied sealing strips detract from the appearance of the finished garment, tent or another commodity Wind and/or moisture will often penetrate into the hollow shank of a rivet in the above outlined button, and even the application of sealing strips cannot cure this problem.

Garments which utilize buttons of the above outlined character are worn by sportsmen, outdoorsmen, workmen, inhabitants of countries having a cold climate all year around or most of the year, and many others. Furthermore, such buttons are often used on tents, covers and many other commodities where two or more plies of flexible textile or other material are to be separably connected to each other, where one of the plies carries one or more buttons and where the other ply or plies are provided with buttonholes.

A snap fastener which is intended to solve similar problems is disclosed in commonly owned copending patent application Ser. No. 07/533,424 filed Jun. 5, 1990, now U.S. Pat. No. 5,003,673 granted Apr. 2, 1991.

OBJECTS OF THE INVENTION

An object of the invention is to provide a simple and relatively inexpensive button which can be applied to a penetrable carrier in such a way that it automatically seals the hole which is made by its rivet.

Another object of the invention is to provide a novel and improved rivet for use in the above outlined button.

A further object of the invention is to provide a button which can be applied to garments, tents or like commodities in available machines.

An additional object of the invention is to provide a novel and improved head for use in the above outlined button.

Still another object of the invention is to provide a novel and improved retaining device for the head of the button.

A further object of the invention is to provide a novel and improved method of enhancing the deformability of the rivet in the above outlined button.

Another object of the invention is to provide a novel and improved socket for use in the button.

An additional object of the invention is to provide a button which can seal the hole in a garment or the like without resorting to membranes and/or sealing strips.

Another object of the invention is to provide a novel and improved universal joint for use in the above outlined button.

SUMMARY OF THE INVENTION

The invention is embodied in a button which can be attached to a penetrable carrier (such as an article of clothing) which has a front (exposed) side and a rear (concealed) side. The improved button comprises a head having a deformable tubular shank which serves to penetrate through the carrier from the front side toward and beyond the rear side of the carrier, and a retaining device which serves to receive, deform and retain the shank at the rear side of the carrier (i.e., after the shank has penetrated through the carrier). The retaining device includes a deformable insert and an enclosure which partially surrounds the insert. The enclosure has an opening and the insert has a front portion which extends from the enclosure through the opening and serves to engage the rear side of the carrier. The enclosure further comprises a deforming portion which is aligned with the opening and the purpose of which is to deform the shank behind the insert upon penetration of the shank through the carrier and the insert.

The insert preferably contains a plastic material and the enclosure preferably contains a metallic material. For example, the enclosure can include or constitute a shallow metallic pan which surrounds and confines the entire insert with the exception of the front portion.

The insert further includes a rear portion which is disposed in the enclosure and has a substantially annular front face surrounding the front portion of the insert. The enclosure can be provided with a collar which overlies the front face of the rear portion and defines the opening for entry of the shank. The insert and the enclosure are preferably round and the front face can extend radially of the insert and outwardly from the front portion. The collar preferably extends radially inwardly of the enclosure and surrounds the opening.

The insert can be provided with a recess for the shank, and such recess is then surrounded by the front portion of the insert. The recess can constitute a hole which extends all the way through the front portion of the insert and to the deforming portion of the enclosure.

The hole in the insert can include a cylindrical portion which is provided in the front portion of the insert and extends toward but short of the deforming portion of the enclosure, and a frustoconical portion which diverges toward the deforming portion and extends from the cylindrical portion to the deforming portion. The deforming portion can extend into the hole, and that (frustoconical) surface of the insert which surrounds the frustoconical portion of the hole can define with the deforming portion an annular clearance which forms part of the frustoconical portion and serves to receive a (deformed) portion of the shank. The outer diameter of the shank is greater than the diameter of the cylindrical portion of the hole.

The enclosure includes a wall which is disposed behind the insert and includes the deforming portion. The deforming portion can include a cone which extends toward the opening. The outer side of the enclosure can be engaged by a rigid back support during penetration of the shank through the carrier and insert and against the cone to be thereby deformed as a result of radial expansion within the enclosure. The back support can form part of a press which is used to apply buttons to garments and the like.

The head of the button includes an enlarged portion (the actual button) which is designed to pass through a buttonhole, and the shank can resemble a hollow conical frustum with a conical external surface which diverges from its open end toward the enlarged portion of the head. The wall thickness of the hollow tubular shank preferably decreases in a direction away from the enlarged portion of the head.

The front portion of the insert can include a centrally located protuberance which extends away from the deforming portion and is penetrated by the shank during assembly of the head with the unit including the insert and the enclosure. The protuberance is preferably round and has a diameter which approximates or matches the inner diameter of the tubular shank, i.e., the entire protuberance can enter the shank as a result of penetration of the shank through the insert on its way toward engagement with and deformation by the deforming portion of the enclosure. The front portion of the insert can abut the deforming portion of the enclosure.

The enlarged portion of the head has a front surface which faces away from and a rear surface which surrounds the shank. The head preferably further comprises a two-piece universal joint which includes an apertured socket at the rear surface of the enlarged portion and a male component having an enlarged section (e.g., a substantially or partially spherical section) in the socket. The male component further comprises a stem which extends from the enlarged section through the aperture of the socket and a rivet which is rigid with the stem outside of the socket. The shank preferably forms an integral part of the rivet. Thus, the shank is rigid with the enlarged section of the male component, and this shank is located outside of the socket. The shank has a first end which serves to penetrate through the carrier and insert, and a second end which can be provided with a radially outwardly extending flange. The male component then includes a portion which surrounds the flange at the second end of the shank. The enlarged portion, the socket, the male component and the shank can constitute a prefabricated unit which is ready to be assembled with the unit including the insert and the enclosure as soon as the shank has been caused to penetrate through the carrier. The male component can include a cup which is integral with the enlarged section and the flange extends into the cup. A rim of the cup is upset over the flange to reliably couple the cup to the shank.

A sealing element can be provided to surround the shank and to abut the front side of the carrier. The sealing element can constitute a prefabricated washer which surrounds the shank. Alternatively, the sealing element can consist of a hardened mass of plastic material which is applied to the head in plasticized state and is thereupon permitted or caused to set. It is also possible to employ a sealing element which is an integral part of the cupped portion of the head.

The aforementioned stem of the head can be made integral with the enlarged section of the universal joint and is preferably rigid with the shank.

The dimensions of the aperture in the socket of the head can be selected in such a way that the aperture can receive the stem with at least some clearance but is too small for the passage of the enlarged section of the universal joint. The socket can be provided with a concave internal surface which surrounds the enlarged section, and the head can comprise means for affixing the socket to the enlarged portion of the head. The affixing means can comprise a radially outwardly extending flange which forms part of the socket and means for securing the flange to the enlarged portion The socket can be made of a deformable material and is then provided with an aperture of variable size so that the enlarged section of the universal joint can pass through the aperture into the socket prior to a reduction of the size of the aperture in order to prevent extraction of the enlarged section from the socket. For example, the socket can be made of ductile metallic sheet material.

It is also possible to employ an elastically deformable enlarged section which can be forced through the aperture of the socket to thereupon expand and be confined in the socket.

The socket can be provided with a radially outward extending flange which is adjacent the rear surface of the enlarged portion of the head. The enlarged portion can include a rim which overlies the flange. Such rim can be a circumferentially complete rim or it can consist of two or more prongs or like parts which overlie the adjacent portions of the flange.

The flange of the socket can be bonded to the rear surface of the enlarged portion of the head. The bonding means can comprise a mass of hardened bonding material, and the rear surface of the enlarged portion of the head can be provided with a barrier (e.g., an annular protuberance extending away from the front surface of the enlarged portion) which is surrounded by the flange and serves to limit the extent of flow of bonding material into the socket before the bonding material hardens The enlarged portion of the head and the enlarged section of the male component of the joint can be provided with neighboring facets (e.g., in the form of flats) which limit the extent of angular movability of the enlarged portion and socket relative to the male component.

The socket can be doubled upon itself to form an inwardly extending collar which surrounds the aperture of the socket and has a concave internal surface surrounding the enlarged section of the male component.

The shank can be provided with at least one weakened portion to facilitate its deformation upon impact against the deforming portion of the enclosure. Such weakened portion can constitute a groove, slot or notch which extends longitudinally of the shank.

The novel features which are considered as characteristic of the invention are set forth in particular in the appended claims. The improved button itself, however, both as to its construction and the mode of assembling and applying the same, together with additional features and advantages thereof, will be best understood upon perusal of the following detailed description of certain presently preferred specific embodiments with reference to the accompanying drawing.

BRIEF DESCRIPTION OF THE DRAWING

FIG. 1*a* illustrates a modified connection between the enlarged portion of the head and the socket of the universal joint;

DESCRIPTION OF PREFERRED EMBODIMENTS

Figure 1:
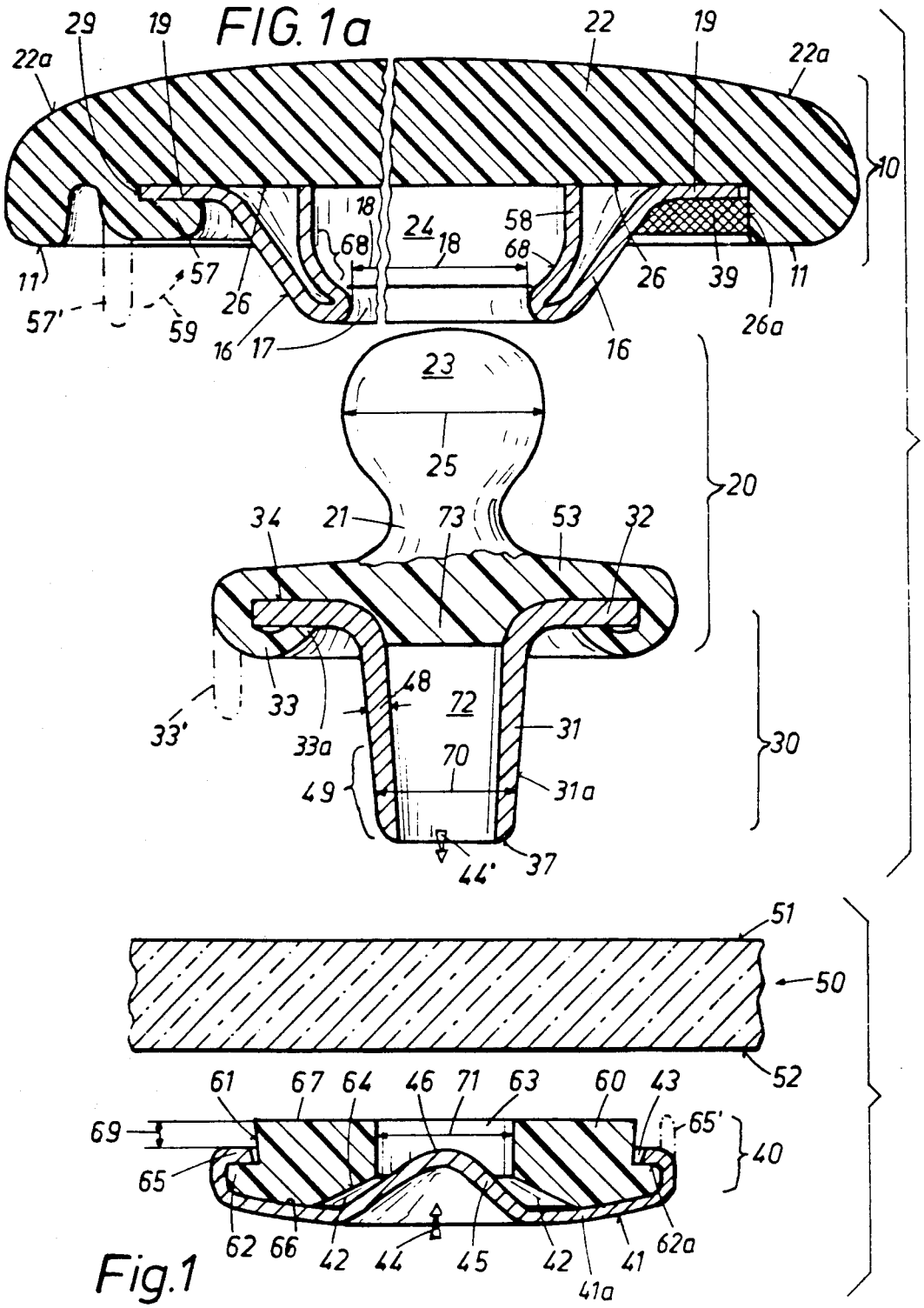
FIG 1 is a greatly enlarged exploded partly elevational and partly central sectional view of a button which embodies one form of the invention, a piece of carrier material being shown between the component parts of the head and the retaining device of the button.

The button which is shown in FIG. 1 comprises a head with an enlarged portion 22 which can be caused to pass through a buttonhole (not shown), and a retaining device 40. In addition to the enlarged portion 22, the head of the improved button comprises a universal joint 20 having a socket 16 at the rear surface 11 of the enlarged portion 22 and a deformable hollow tubular shank 31 which can be deformed by a deforming portion 45 of the retaining device 40 subsequent to penetration through a carrier 50, e.g., a piece of fabric forming part of a garment, a tent or the like. In accordance with a feature of the invention, the enlarged portion 22 and the socket 16 can be assembled into a first prefabricated unit 10, the parts of the male component of the universal joint 20 can be assembled into a second prefabricated unit 30, and the parts of the retaining device 40 can be assembled into a third prefabricated unit. The male component of the universal joint 20 includes the shank 31, an enlarged section 23 which is receivable in the socket 16, a rivet 53 which is rigidly connected to the shank 31, and a stem or neck 21 which integrally connects the enlarged section 23 to the rivet 53. When the button is fully assembled and is properly secured to the carrier 50, the enlarged portion 22, the socket 16, the parts 21, 23, 53 of the male component, and a radially outwardly extending flange 32 at the front end of the shank 31 are located at the exposed front side 51 of the carrier, a portion of the shank 31 extends through the carrier 50 in a direction from the front side 51 toward and beyond the concealed rear side 52, and the retaining device 40 as well as the remaining portion of the shank 31 are located at the rear side 52 of the carrier. At such time, a cupped portion 33 of the rivet 53 sealingly engages the front side 51 and the front portion 61 of a deformable insert 60 of the retaining portion 40 sealingly engages the rear side 52 of the carrier 50 around the hole which is made by the shank 31 as a result of penetration through the carrier and through a recess or hole 63 of the insert 60 toward and into engagement with the deforming portion 45 of a shallow round metallic pan-shaped enclosure 41 of the retaining device 47. The carrier 50 may but need not be provided with a climatic membrane. The buttonhole is formed in a second piece of fabric (not shown) which overlies the front side 51 of the carrier 50 when the button of FIG. 1 is in actual use, i.e., when the enlarged portion 22 of the head extends through the buttonhole of the second piece of fabric so that its convex front surface 22*a* is visible at the front side of the second piece of fabric.

The universal joint 20 including the socket 16 and the rivet 53 with stem or neck 21 and enlarged section 23 can be made of a cast metallic material. FIG. 1 shows that the socket 16 is made of metallic sheet stock and that the rivet 53 is made of a plastic material, preferably a slightly deformable and slightly elastic material. The shank 31 is made of a ductile metallic material and its tubular portion is a hollow conical frustum which diverges in a direction from its open end 37 toward the flange 32. The wall thickness 48 of the tubular portion of the shank 31 increases in the same direction, i.e., from the free end 37 toward the flange 32. The purpose of the flange 32 is to facilitate attachment of the separately produced shank 31 to the rivet 53 of the male component of the universal joint 20.

Prior to assembly of the rivet 53 with the shank 31, the cupped portion 33 of the rivet 53 constitutes a relatively short cylinder (indicated by phantom lines, as at 33') so that it can readily receive the flange 32. The cupped portion (33') is thereupon upset so that it overlies the rear side of the flange 32, and the rim 33*a* of the thus upset cupped portion 33 sealingly engages the flange to prevent penetration of air and/or moisture around the flange and into the internal space 72 of the shank 31. At the same time, a centrally located plug 73 of the rivet 53 extends into the front end of the shank 31 to even further reduce the likelihood of penetration of wind and/or moisture into the internal space 72 of the shank. The plug 73 is surrounded by a surface 34 which is in sealing engagement with the front side of the flange 32 when the conversion of the originally cylindrical cupped portion 33' into the upset cupped portion 33 is completed. Deformation of the cupped portion 33' can be carried out as a result of the application of heat and pressure.

The enlarged portion 22 of the head of the button which is shown in FIG. 1 can be made of a metallic or plastic material. The illustrated enlarged portion 22 is made of a plastic material which is or can be the same as that of the rivet 53. The rear surface 11 of the enlarged portion 22 is formed with an annular recess 26 which receives the radially outwardly extending flange 19 of the socket 16. This socket has a frustoconical outer wall which merges into the flange 19 and an internal collar 58 which surrounds a centrally located aperture 17 as well as a chamber 24 for the enlarged section 23 of the male component of the universal joint 20. The diameter 18 of the aperture 17 is somewhat smaller than the diameter 25 of the enlarged section 23. However, the resiliency and deformability of the enlarged section 23 and/or socket 16 suffice to permit forcible introduction of the enlarged section 23 through the aperture 17 and into the chamber 24 so that the assembly of the joint 20 is then completed, i.e., the shank 31 and the enlarged portion 22 can turn relative to each other about a plurality of mutually inclined axes.

The preferably flat washer-like flange 19 of the socket 16 is secured or affixed to the enlarged portion 22 of the head by a ring-shaped body of hardened bonding agent 39 which is introduced into the recess 26 of the rear surface 11 in a plastic state while the enlarged portion 22 is turned upside down, i.e., while the open side of the recess 26 faces upwardly. When the bonding agent 39 sets, it forms a ring which overlies the rear side of the flange 19 and adheres to this flange as well as to a portion of the frustoconical wall of the socket 16 and to the surface 26*a* of the enlarged portion 22 to ensure reliable retention of the socket 16 in the position which is shown in FIG. 1.

Once the enlarged section 23 of the male component of the joint 20 has entered the chamber 24, the socket 16 and the enlarged section 23 reassume their undeformed states and the enlarged portion 22 is articulately and more or less permanently connected with the shank 31. The resiliency of the enlarged section 23 can be enhanced by immersion in water. Once the enlarged section 23 has penetrated into the chamber 24 by snap action, the water is free to evaporate to thus enhance the hardness (i.e., reduce the deformability) of the enlarged section 23 in order to ensure that the socket 16 and the male component of the joint 20 can be separated only in response to the exertion of a rather pronounced force.

The purpose of the collar 58 is to reduce the likelihood of scratching of the enlarged section 23 during and subsequent to introduction into the chamber 24. The concave internal surface 68 of the collar 58 spacedly surrounds the inserted enlarged section 23. The front end face of the collar 58 abuts the surface at the bottom of the recess 26 in the rear surface 11 of the enlarged portion 22 of the head. If desired, the configuration of the collar 58 can even more closely conform to the outline of the enlarged section 23, i.e., the section 23 and the collar 58 can form a typical ball and socket joint.

The shank 31 can be permanently connected with the retaining device 40 prior to introduction of the enlarged section 23 into the chamber 24 of the socket 16. However, it is presently preferred to assemble the enlarged section 23 and the socket 16 (and enlarged portion 22) in a first step and to thereupon cause the shank 31 to penetrate into and through the carrier 50 for the purpose of being deformed by the portion 45 of the enclosure 41. Such mode of completing the assembly of the button with the carrier 50 simplifies the manipulation of the head at the front side 51 of the carrier 50. The head is introduced into the upper applicator of a suitable press, not shown, and the retaining device 40 is introduced into the lower applicator of such press. Presses which can be used for the application of head and retaining portion of the improved button to garments or the like are disclosed in numerous patents of the assignee of the present application. Reference may be had, for example, to U.S. Pats. Nos. 4,541,558, 4,566,182, 4,596,349, 4,659,001, 4,694,984 and 4,703,882. The applicators of the press ensure proper orientation of the head and retaining device 40 during penetration of the shank 31 through a carrier 50 which is placed over the lower applicator so that it overlies the retaining device. The directions in which the upper and lower applicators of the press move the head and the retaining device 40 toward the respective sides 51, 52 of the carrier 50 during attachment of the button to the carrier are indicated by arrows 44' and 44. The free end 37 of the shank 31 is sufficiently sharp to readily penetrate through the carrier 50 prior to entering the recess or hole 63 of the insert 60 in the enclosure 41 of the retaining device 40.

The front portion 61 of the insert 60 projects forwardly through a central opening 43 of the enclosure 41 through a distance 69 so that its front surface 67 can abut the rear side 52 of the carrier 50 when the attachment of the button to the carrier is completed. The rear portion 62 of the insert 60 is fully concealed in the enclosure 41 and abuts the front side 66 of the rear wall 41*a* of the enclosure. The insert 60 is made of a deformable plastic material and its hole 63 includes a cylindrical front portion having a diameter 71 and extending from the front surface 67 toward the deforming portion 45 of the rear wall 41*a*, and a frustoconical rear portion 64 which diverges toward the rear wall 41*a*. The surface bounding the rear portion 64 of the hole 63 defines with the deforming portion 45 an annular clearance 42 for the deformed rear end portion 49 of the shank 31. The diameter 71 of the cylindrical front end portion of the hole 63 is or can be somewhat smaller than the outer diameter 70 of the rear end portion 49 of the shank 31 so that the shank expands and its external surface 31*a* sealingly engages the front and rear portions 61, 62 of the insert 60 subsequent to penetration through the carrier 50 and during movement toward the deforming portion 45. The enclosure 41 can be made of brass or another suitable metallic material and the exposed rear surface of its wall 41*a* preferably lies flat against the lower applicator (back support) of the press during assembly of the head with the retaining device 40 of the improved button.

The enclosure 41 comprises an originally cylindrical collar 65 which defines the opening 43 for the front portion 61 of the insert 60 and overlies the annular front face 62*a* of the rear portion 62. A portion of the collar 65 prior to deformation is shown by phantom lines at 65'. The parts 41, 60 of the retaining device 40 are assembled with each other into the unit which is shown in the lower portion of FIG. 1 prior to attachment of the button to the carrier 50. This simplifies the manipulation of the retaining device 40. Successive retaining devices 40 of a series of properly oriented retaining devices are fed to the lower applicator of a press in a fully automatic way, for example, as described in certain of the above-enumerated patents which are owned by the assignee of the present application. At least that portion of the lower applicator which abuts the rear side of the wall 41*a* of the enclosure 41 is preferably made of hardened steel or another hard material which can adequately support the enclosure 41 (and particularly the deforming portion 45) during deformation of the shank 31, i.e., during expansion of the rear end portion 49 of the shank 31 as a result of movement relative to the front side of the deforming portion 45 so that the radially expanded end portion 49 enters the annular clearance 42, i.e., the rearmost zone of the frustoconical portion 64 of the recess or hole 63 in the insert 60. The tip 46 of the deforming portion 45 which is shown in FIG. 1 extends well into the cylindrical front portion of the hole 63 and into the open end 37 of the shank 31 when the latter is caused to move in the direction of arrow 44', first through the carrier 50 and thereupon into and through the insert 60. When the assembling step is completed, the clearance 42 is filled with the material of the deformed shank 31 and the deformed end portion 49 of the shank sealingly engages the inner side of the wall 41*a* as well as the surface bounding the (originally) frustoconical rear portion 64 of the hole 63 in the insert 60. The deformed collar 65 of the enclosure 41 sealingly engages the annular front face 62*a* of the rear portion 62 of the insert 60, and the front surface 67 of the front portion 61 of the insert bears against the rear side 52 of the carrier 50 all the way around the hole which was made by the shank 31 so that such hole is reliably sealed from the surrounding atmosphere. Thus, even if water and/or wind is free to penetrate through the carrier 50 from the front side 51 and around the hole for the shank 31, such fluid cannot penetrate along the front surface 67 and radially outwardly beyond the front portion 61 of the then deformed insert 60. Furthermore, even if water and/or wind happens to penetrate into the internal space 72 of the shank 31, such fluid is sealed in the space 72 and cannot reach the opening 43 because the deformed insert 60 bears against the outer side of the deformed rear end portion 49 of the shank 31, against the front side of the wall 41*a* and against the rear or inner side of the deformed collar 65 of the enclosure 41.

The outer diameter of the shank 31 at its open rear end 37 need not appreciably exceed or can be even less than the diameter 71 of the cylindrical front portion of the hole 61 in the insert 60. However, the outer diameter of the shank 31 increases toward the flange 32 to an extent which is amply sufficient to ensure adequate expansion of the front and rear portions 61, 62 of the insert 60 while the shank 31 is in the process of penetrating into the hole 63 and of being expanded by the deforming portion 45 of the rear wall 41*a*. When the deforming step is completed, the rear end portion 49 of the shank 31 is converted into a radially outwardly and rearwardly extending hollow cone which abuts the front side of the deforming portion 45 and fills the annular clearance 42. The deformed shank 31 maintains the elastically deformable insert 60 in stressed condition because a substantial part of the insert 60 is confined in the metallic enclosure 41.

As a rule, the extent of penetration of the shank 31 into the insert 60 suffices to ensure at least some deformation of the front portion 61 (i.e., the axial length of the projecting part 69 is reduced) so that the front surface 67 is maintained in permanent sealing engagement with the rear side 52 of the carrier 50 which is clamped between the insert 60 and the upset cupped portion 33 of the rivet 53. This establishes a highly reliable seal which prevents penetration of wind and/or moisture into the hole of the carrier 50 from the front side 51 as well as from the rear side 52.

The rim 33*a* of the upset cupped portion 33 cooperates with the plug 73 to prevent penetration of wind and/or moisture into the internal space 72 of the shank 31 along the front side 51 of the carrier 50. In addition, the plug 73 centers the shank 31 relative to the rivet 53 and vice versa.

FIG. 1*a* shows a portion of a modified head, namely another mode of securing or affixing the flange 19 of the socket 16 to the rear surface 11 of the enlarged portion 19. The rear side 11 is formed with an originally cylindrical rim 57 (shown at 57'). When the flange 19 is properly received in the recess 26, the rim (57') is deformed in the direction of arrow 59 so that it overlies and sealingly engages the rear side as well as the peripheral surface 29 of the flange 19. This establishes a reliable mechanical and sealing connection between the socket 16 and the enlarged portion 19 of the head. The socket 16 of FIG. 1*a* is or can be identical with the similarly referenced socket of FIG. 1.

The rim 57 of the enlarged portion 22 may but need not be a circumferentially complete part. For example, this rim can consist of a plurality of prongs which are bent over the rear side of the flange 19 to establish a reliable mechanical connection between the parts 16 and 22. The prongs can be bent (arrow 59) simultaneously or one after the other.

Figure 2:
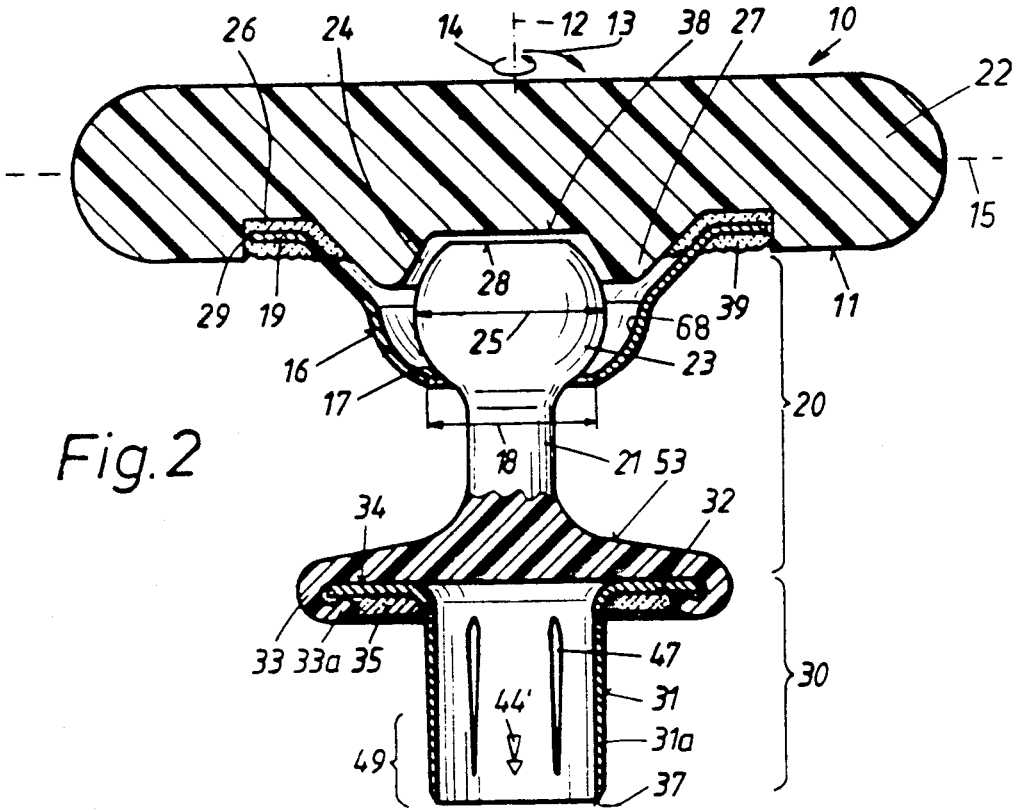
FIG. 2 is an enlarged partly elevational and partly central sectional view of a modified head.

FIG. 2 shows a modified head which can be used with the retaining device 40 of FIG. 1. All such parts of the modified head which are analogous to or identical with the corresponding parts of the head which is shown in FIG. 1 are denoted by similar reference characters.

The socket 16 of the universal joint 20 which is shown in FIG. 2 is made of a single layer of metallic sheet material, i.e., the concave internal surface 68 is provided directly on the frustoconical portion which merges into the radially outwardly extending flange 19 of the socket. The flange 19 is secured or affixed to the enlarged portion 22 of the head by a hardened bonding agent 39 which fills the recess 26 in the rear surface 11 of the enlarged portion 22. The bonding agent 39 is poured or is otherwise introduced into the recess 26 while the surface 11 of the enlarged portion 22 faces upwardly. Since the socket 16 of FIG. 2 does not have a collar 58 which could obstruct the flow of plasticized bonding agent 39 toward the chamber 24 for the enlarged section 23 of the male component of the universal joint 20, the rear surface 11 of the enlarged portion 22 is formed with an annular barrier 27 which is inwardly adjacent the flange 19 and limits the extent of flow of plasticized or liquefied bonding agent 39 toward the chamber 24. A facet or flat 38 within the annular barrier 27 serves as an abutment for a similar facet or flat 28 of the enlarged section 23 during pouring of plasticized or liquefied bonding agent 39 into the recess 26. The facets 28 and 38 can further serve to limit the extent of tiltability of the enlarged portion 22 and enlarged section 23 relative to each other when the assembly of the button is completed. The plane of the facet 38 is parallel to the central plane 15 of the enlarged portion 22. The illustrated facets 28, 38 are but need not be exactly flat.

Another difference between the head of FIG. 2 and the head of the button which is shown in FIG. 1 is that the rivet 53 carries a washer-like sealing element 35 which is surrounded by the cupped portion 33 and sealingly engages the rear side of the flange 32 as well as the front portion of the external surface 31*a* of the shank 31. The sealing element 35 engages the front side 51 of the carrier 50 (not shown in FIG. 2) in order to further reduce the likelihood of penetration of wind and/or moisture along the outer side 51 and into the hole which is formed by the shank 31 as a result of penetration through the carrier. The material of the sealing element 35 is or can be the same as that of the bonding agent 39, and such material is introduced in a flowable (plasticized or liquid) state to fill the space within the upset cupped portion 33 of the rivet 53. However, it is equally possible to use a prefabricated washer-like sealing element which is slipped onto the shank 31 prior or subsequent to upsetting of the cupped portion 33 and which is caused to bear against the front side 51 of the carrier 50 during deformation of the shank 31 by the deforming portion 45 of the enclosure 41 forming part of a retaining device of the type shown in the lower portion of FIG. 1.

The shank 31 of FIG. 2 is substantially cylindrical and is provided with one or more elongated weakened portions 47 in the form of notches, slots and/or grooves which facilitate deformation of the shank under the action of the deforming portion 45. Thus, the shank 31 of FIG. 2 is split into several radially outwardly bent prongs as a result of deformation during penetration into the retaining device 40. Such prongs are received in the annular clearance 42 between the insert 60 and the enclosure 41 of the retaining device 40 when the deforming step is completed.

The arrows 13 and 14 denote in FIG. 2 that the enlarged portion 22 is free to turn about the axis 12 of the enlarged section 23 as well as that the enlarged portion 22 can be tiled relative to the male component of the universal joint 20. The socket 16 shares the angular and/or tilting movements of the enlarged portion 22 relative to the enlarged section 23. The central plane 15 of the enlarged portion 22 normally extends at right angles to the axis 12 when the enlarged portion extends through the buttonhole of a layer of textile or other material overlying the carrier 50 through which the shank 31 extends. The enlarged portion 22 will be tilted in the direction of arrow 13 or in any other direction in order to facilitate passage of such enlarged portion through or withdrawal of the enlarged portion by way of a buttonhole.

The sealing element 35 can be omitted if the rim 33*a* of the cupped portion 33 is deformed into adequate sealing engagement with the rear side of the flange 32 at the surface 34 of the rivet 53.

Figure 3:
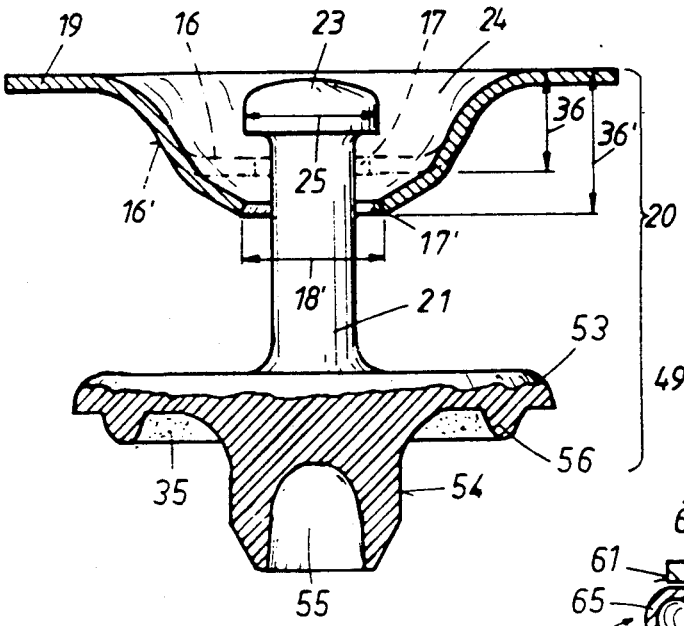
FIG. 3 is an enlarged partly elevational and partly central sectional view of a portion of a third head.

FIG. 3 shows that the enlarged section 23 and stem 21 of the male component of the universal joint 20 can be made of a non-deformable metallic material. The initial shape (see 16') of the socket 16 is selected in such a way that the diameter 18' of its aperture 17' is greater than the diameter 25 of the enlarged section 23. Thus, the section 23 can be readily inserted into and withdrawn from the chamber 24 of the socket 16. The socket is thereupon deformed (so that its axial length is changed from 36' to 36) with attendant reduction of the diameter of the aperture 18' so that the enlarged section 23 is confined in and can no longer leave the chamber 24. The original (undeformed socket is shown at 16', its aperture at 17' and the diameter of its aperture 17' at 18'. The axial length of the socket is reduced from 36' to 36. This suffices to reduce the diameter of the aperture from 18' to less than 25. When the assembly of the enlarged section 23 and stem 21 with the socket 16 is completed, the flange 19 of this socket is secured or affixed to the enlarged portion 22 (not shown in FIG. 3) of the head in a manner as shown in FIG. 1, 1*a* or 2.

FIG. 3 further shows that the male component of the joint 20 can be made of a metallic material and that the rivet 53 can be integral with a modified deformable (expandible) shank 54 having an axial recess 55. The axis of the rivet 53 and shank 54 coincides with the common axis of the enlarged section 23 and stem 21. The recess 55 receives the tip 46 of the deforming portion 45 when the shank 54 is coupled with a retaining device, such as the retaining device 40 shown in the lower part of FIG. 1.

The rear side of the rivet 53 has an annular rib 56 which corresponds to the cupped portion 33 of FIG. 2 and surrounds a ring-shaped sealing element 35 of hardened plastic material. This sealing element 35 can be replaced with a prefabricated washer which is slipped onto the external surface of the shank 54.

Figure 4:
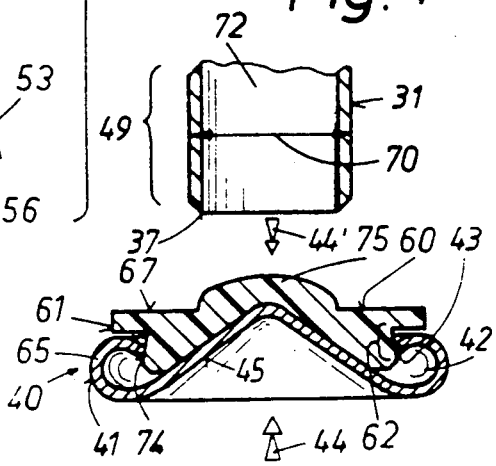
FIG. 4 is an enlarged fragmentary exploded view of a portion of a fourth button with a different retaining device for the shank of the head.

The retaining device 40 of FIG. 4 differs from that which is shown in FIG. 1 in that the insert 60 has a centrally located round protuberance 75 which projects forwardly beyond the front surface 67 of the front portion 61. Furthermore the hole or recess 63 is omitted and the deforming portion 45 of the enclosure 41 abuts the rear side of the insert 60 even before the latter is penetrated by the shank 31 or 54. Still further, the front portion 61 of the insert 60 extends radially outwardly beyond and overlies the deformed collar 65 of the enclosure 41. The collar 65 defines the opening 43 which surrounds the rear portion 62 of the insert 60. The diameter of the rear portion 62 is smaller than that of the front portion 61. The peripheral surface 74 of the rear portion 62 of the insert 60 is a conical surface which diverges in a direction away from the front surface 67.

The diameter of the round protuberance 75 equals or even exceeds the outer diameter of the hollow cylindrical shank 31. The sharp rear end 37 of the shank 31 severs the insert 60 at the periphery of the protuberance 75 on its way toward engagement with and deformation by the conical front side of the deforming portion 45. The severed protuberance 75 constitutes a plug which is sealingly received in the internal space 72 of the deformed shank 31 and thus even further reduces the likelihood of penetration of water and/or wind from the front end of the shank 31 toward the opening 43 of the enclosure 41.

The clearance 42 is filled with the material of the rear portion 62 of the insert 60 when the deformation of the shank 31 by the portion 45 of the enclosure 41 is completed.

An important advantage of the improved button is that it reliably prevents penetration of wind and/or water through the hole which is formed in the carrier 50 as a result of penetration of the shank 31 or 54 from the front side 51 toward and beyond the rear side 52 of the carrier. This is due to deformability of the insert 60 of the retaining device 40 and to deformation of the shank 31 or 54 in the interior of the device 40, i.e., within the enclosure 41. The deformed shank 31 or 54 maintains the deformed insert 60 in pronounced sealing engagement with the internal surface of the enclosure 41 so that any flow of fluid along the external surface of the shank 31 or 54 and/or along the internal surface of the shank 31 is prevented in a highly reliable manner.

Another advantage of the improved button is that separation of the universal joint 20 from the retaining device 40 is highly unlikely. Thus, the rear end of the shank 31 or 54 is deformed radially outwardly so that extraction of the thus deformed rear end of the shank would necessitate expulsion of the insert 60 from the enclosure 41. This is practically impossible because the rear portion 62 of the insert 60 has undergone pronounced radial expansion and fills the enclosure 41 due to deformability of the material of the insert 60.

A further advantage of the improved button is that the deformed insert 60 can perform at least one additional function, namely that of establishing a reliable seal between the front surface 67 of the front portion 61 and the rear side 52 of the carrier 50 all the way around the hole which is formed as a result of penetration of the shank 31 or 54 through the carrier Thus, the insert can reliably lock the deformed portion of the shank 31 or 54 in the retaining device 40 and the insert is also capable of sealing the hole of the carrier 50 for the shank 31 or 54 at the rear side 52 of the carrier all the way along the front surface 67 of the deformed front portion 61 of the insert.

A further important advantage of the improved button is that its head 10+20+30 and retaining portion 40 can be assembled in existing types of presses. Such presses must be modified only to an extent which is necessary to properly orient the head (preferably in the upper applicator of the press) and the retaining device 40 (preferably in the lower applicator).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A button for attachment to a penetrable carrier, such as a garment, which has a front side and a rear side, comprising a head having an enlarged portion arranged to pass through a buttonhole and a deformable tubular shank articulately connected with said enlarged portion and arranged to penetrate through the carrier from the front side toward and beyond the rear side of the carrier; and a preassembled retaining device arranged to receive, deform and retain the shank at the rear side of the carrier, said device including an elastically deformable plastic insert and a metallic enclosure partially surrounding said insert, said enclosure having an opening and said insert having a rear portion in said enclosure and a front portion extending from said enclosure through said opening and having a substantially plane front surface arranged to engage the rear side of the carrier, said enclosure further comprising a rear wall and a sidewall defining with said rear wall a chamber for the rear portion of said insert, said sidewall having an opening for said front portion of said insert and said rear portion of said insert defining with said rear wall a clearance in communication with said opening, said enclosure also comprising a deforming portion aligned with said opening and arranged to deform said shank behind said insert into said clearance upon penetration of the shank through the carrier and said insert.

2. The button of claim 1, wherein said enclosure includes a shallow metallic pan which surrounds and confines the entire rear portion of said insert.

3. The button of claim 1, wherein said rear portion has a substantially annular front face surrounding said front portion, said sidewall including a collar which overlies said front face and defines said opening.

4. The button of claim 3, wherein said insert and said enclosure are substantially round and said front face extends outwardly from said front portion radially of said insert, said collar extending radially inwardly of said enclosure and surrounding said opening.

5. The button of claim 1, wherein said insert has a recess for said shank, said recess being surrounded by said front portion.

6. The button of claim 5, wherein said recess is a hole which extends through said front portion and on to said deforming portion.

7. The button of claim 6, wherein said hole has a cylindrical portion provided in said front portion and extending toward but short of said deforming portion, and a frustoconical portion diverging toward said deforming portion and extending from said cylindrical portion to said deforming portion.

8. The button of claim 7, wherein said deforming portion extends into said hole and said insert has a frustoconical surface surrounding the frustoconical portion of said hole and defining with said deforming portion an annular clearance forming part of said frustoconical portion and arranged to receive a portion of said shank.

9. A button for attachment to a penetrable carrier, such as a garment, which has a front side and a rear side, comprising a head having a deformable tubular shank arranged to penetrate through the carrier from the front side toward and beyond the rear side of the carrier; and a retaining device arranged to receive, deform and retain the shank at the rear side of the carrier, said device including an elastically deformable insert having a recess for said shank, and and enclosure partially surrounding said insert, said enclosure having an opening and said insert having a front portion surrounding said recess, extending from said enclosure through said opening and arranged to engage the rear side of the carrier, said enclosure further comprising a deforming portion aligned with said opening and arranged to deform said shank behind said insert upon penetration of the shank through the carrier and said insert, said recess constituting a hole which extends through said front portion and on to said deforming portion, said hole having a first diameter and said shank having an outer diameter greater than said first diameter.

10. The button of claim 1, wherein said rear wall includes said deforming portion, said deforming portion including a cone extending toward said opening.

11. The button of claim 10, wherein said enclosure has an outer side arranged to be engaged by a rigid back support during penetration of said shank through the carrier and said insert and against said cone to be thereby deformed as a result of radial expansion within said enclosure.

12. The button of claim 1, wherein said shank has a conical external surface which diverges toward said enlarged portion.

13. The button of claim 12, wherein the wall thickness of said hollow tubular shank decreases in a direction away from said enlarged portion.

14. The button of claim 1, wherein said front portion includes a central protuberance extending away from said deforming portion.

15. The button of claim 14, wherein said protuberance is round and has a diameter approximating the inner diameter of said tubular shank.

16. The button of claim 14, wherein said front portion of said insert abuts said deforming portion of said enclosure.

17. The button of claim 1, wherein said enlarged portion has a front surface and a rear surface, said head further comprising a two-piece universal joint including an apertured socket at the rear surface of said enlarged portion and a male component having an enlarged section in said socket, a stem extending from the enlarged section through the apertured socket and a rivet rigid with said stem outside of said socket, said shank forming an integral part of said rivet.

18. The button of claim 1, wherein said enlarged portion has a front surface and a rear surface, said head further comprising a universal joint including an apertured socket at the rear surface of said enlarged portion and a male component having an enlarged section in said socket, said shank being rigid with said enlarged section and being located outside of said socket.

19. The button of claim 18, wherein said shank has a first end arranged to penetrate through the carrier and said insert and a second end provided with a radially outwardly extending flange, said male component having a portion which surrounds said flange, said enlarged portion and said socket and said male component and said shank constituting a prefabricated unit.

20. The button of claim 19, wherein said male component has a cup which is integral with said enlarged section and said flange extends into said cup, said cup having a rim which is upset over said flange.

21. The button of claim 1, wherein said enlarged portion has a front surface and a rear surface, said head further comprising a universal joint including an apertured socket at the rear surface of said enlarged portion, said joint further including a male component having an enlarged section in said socket and a cupped portion rigid with said enlarged section and with said shank, and further comprising a sealing element surrounding said shank and arranged to abut the front side of the carrier.

22. The button of claim 21, wherein said cupped portion has a rim surrounding said sealing element.

23. The button of claim 22, wherein said sealing element is a prefabricated washer which surrounds said shank.

24. The button of claim 22, wherein said sealing element is a hardened mass of plastic material.

25. The button of claim 21, wherein said sealing element includes an integral part of said cupped portion.

26. The button of claim 1, wherein said enlarged portion has a front surface and a rear surface, said head further comprising a universal joint connecting said enlarged portion with said shank, said universal joint including an apertured socket at the rear surface of said enlarged portion and a male component including an enlarged section in said socket, said shank being rigid with said enlarged section and being located outside of said socket.

27. The button of claim 26, wherein said male component further comprises a stem which is integral with said enlarged section and extends from said apertured socket and is rigid with said shank.

28. The button of claim 26, wherein said socket has an aperture which is sufficiently large to receive said stem with at least some clearance but is too small for the passage of said enlarged section therethrough.

29. The button of claim 28, wherein said socket has a concave internal surface surrounding said enlarged section and further comprising means for affixing said socket to said enlarged portion of said head.

30. The button of claim 29, wherein said affixing means comprises a radially outwardly extending flange forming part of said socket and means for securing said flange to said enlarged portion.

31. The button of claim 26, wherein said socket consists of a deformable material and has an aperture of variable size so that said enlarged section can pass through said aperture into said socket prior to a reduction of the size of said aperture for the purpose of preventing extraction of the enlarged section from the socket.

32. The button of claim 31, wherein said socket consists of metallic sheet material.

33. The button of claim 26, wherein said enlarged section is elastically deformable so that it can be forced through the aperture of said socket to thereupon expand and be confined in the socket.

34. The button of claim 26, wherein said socket has a radially outwardly extending flange adjacent the rear surface of said enlarged portion and said enlarged portion has a rim which overlies said flange.

35. The button of claim 34, wherein said rim is a circumferentially complete rim.

36. The button of claim 26, wherein said socket has a radially outwardly extending flange at the rear surface of said enlarged portion and means for bonding said flange to said enlarged portion.

37. The button of claim 26, wherein said enlarged portion and said enlarged section have adjacent facets which limit the extent of movability of said enlarged portion and said socket relative to said male component.

38. The button of claim 26, wherein said socket has a substantially centrally located aperture for a stem of said male component intermediate said enlarged section and said shank, said socket having an inwardly extending collar surrounding said aperture and having a concave surface surrounding said enlarged section.

39. The button of claim 1, wherein said shank has at least one weakened portion to facilitate its deformation upon impact against said deforming portion.

40. The button of claim 39, wherein said at least one weakened portion includes a groove extending longitudinally of said shank.

41. A button for attachment to a penetrable carrier, such as a garment, which has a front side and a rear side, comprising a head having a deformable tubular shank arranged to penetrate through the carrier from the front side toward and beyond the rear side of the carrier, said head further having an enlarged portion arranged to pass through a buttonhole and having a front surface and a rear surface, and a universal joint connecting said enlarged portion with said shank, said universal joint including an apertured socket at the rear surface of said enlarged portion and a male component including an enlarged section in said socket, said shank being rigid with said enlarged section and being located outside of said socket, said socket having a radially outwardly extending flange at the rear surface of said enlarged portion and means for bonding said flange to said enlarged portion, said bonding means comprising a mass of hardened bonding material and said rear surface being provided with a barrier which is surrounded by said flange and limits the extent of flow of bonding material into said socket prior to hardening of the bonding material; and a retaining device arranged to receive, deform and retain the shank at the rear side of the carrier, said device including an elastically deformable insert and an enclosure partially surrounding said insert, said enclosure having an opening and said insert having a front portion extending from said enclosure through said opening and arranged to engage the rear side of the carrier, said enclosure further comprising a deforming portion aligned with said opening and arranged to deform said shank behind said insert upon penetration of the shank through the carrier and said insert.

* * * * *